United States Patent [19]

Montijo

[11] Patent Number: 4,715,070

[45] Date of Patent: Dec. 29, 1987

[54] FLOTATION POOL BLANKET

[76] Inventor: James K. Montijo, 2401 Pine St., Bakersfield, Calif. 93301

[21] Appl. No.: 947,264

[22] Filed: Dec. 29, 1986

[51] Int. Cl.[4] ..... E04H 3/19
[52] U.S. Cl. ..... 4/498
[58] Field of Search ..... 4/502, 503, 504, 505, 4/499, 498, 494

[56] References Cited

U.S. PATENT DOCUMENTS

| | | | |
|---|---|---|---|
| 2,580,555 | 1/1952 | Kroeger | 4/502 |
| 3,000,017 | 9/1961 | Skovira . | |
| 3,128,478 | 4/1964 | Beal . | |
| 3,534,412 | 10/1970 | Crook | 4/498 |
| 3,600,721 | 8/1971 | Pusey . | |
| 4,094,021 | 6/1978 | Rapp . | |
| 4,109,325 | 8/1978 | Shuff . | |
| 4,192,025 | 3/1980 | Hinsperger | 4/498 |
| 4,251,889 | 2/1981 | Lof . | |
| 4,257,132 | 3/1981 | Kerby | 4/503 |

FOREIGN PATENT DOCUMENTS 3512134 10/1986 Fed. Rep. of Germany ..... 4/498

*Primary Examiner*—James E. Bryant, III
*Assistant Examiner*—L. J. Peters
*Attorney, Agent, or Firm*—J. Michael McClanahan

[57] ABSTRACT

A flotation pool blanket for covering a swimming pool adapted to be gathered when removed, said flotation pool blanket defining a blanket covering the water of the pool having at spaced intervals, parallel ribs underlying the blanket, the ribs at each end rising up to form ears which overlap and engage the top of the pool decking surrounding and defining the pool. Further, the ears provide means by which the flotation pool blanket may be gathered up for removal by starting at one end, picking up the rib, proceeding to the next rib and repeating the step until all the ribs have been picked up at which time the blanket and the ribs carried to a position away from the pool. Emplacement of the invention pool blanket is just the opposite of removal, the operators dropping one end of the flotation pool blanket in the pool and then proceeding to let out a rib as they traverse the length of the pool.

17 Claims, 8 Drawing Figures

FLOTATION POOL BLANKET

BACKGROUND OF THE INVENTION

1 Field of the Invention. The field of the invention is protective covers for swimming pools.

2. Description of Related Art. Swimming pool covers are utilized by owners of swimming pools for many reasons such as safety, i.e., to provide a cover for the pool during periods of non-use which will prevent a child who has fallen into the pool from going under water or drowning. In most of these cases, the pool cover is usually supported on the sides of the pool. In addition, there are health reasons for such a protective cover, such as preventing dust or other materials from falling into the water surface and then either being dissolved in the water or sinking to the bottom. Further, the pool covers may be used to keep a pool warmer by effecting retention of heat in the water such as that a wind passing over the water surface will not remove the heat as fast as it would on an unprotected pool. In this regard, pool covers may also be made of dark materials which absorb heat from the sun and transfer that heat into the water and thus provide a means for heating the pool. Lastly, a pool cover may be utilized to prevent the rapid dissipation of chlorine from the water which the operator has added to keep the pool sanitized.

Numerous pool type blankets have been patented by various and different persons, such as the blanket shown in U.S. Pat. No. 4,109,325 to Shuff wherein a buoyant cover floats on the top of the pool with ballast weights added at the edges of the cover to keep it in position upon the pool. In addition, other variations have been disclosed such as the swimming pool cover shown in U.S. Pat. No. 4,094,021 to Rapp wherein a blanket is held in place by tie anchoring members secured to the pool side walls. Pusey, in U.S. Pat. No. 3,600,721 shows a variation of Shuff's device wherein the plenum between the pool blanket and the water surface may be inflated to cause the blanket to rise substantially above the water surface, sufficient for a person to enter the plenum.

Lof details a swimming pool cover in U.S. Pat. No. 4,251,889 having a rigid framework attached to a plastic cover where the cover floats on the water and the framework is tied to the pool decking at spaced apart positions.

However, none of the prior art illustrates a pool blanket which provides all of the safety, health, and heat retention features and in addition, is constructed such as to be easily and neatly removed and stacked or set off from the pool and then replaced with minimum effort.

Accordingly, it is apparent that there is a need for a flotation pool blanket which provides all of the above features and in addition, provides easy methods of removal of the blanket from the swimming pool and easy methods of replacing the blanket when desired.

SUMMARY OF THE INVENTION

This invention relates to apparatus for a flotation pool blanket adapted to cover a swimming pool at the water level as a barrier between the water and the surrounding environment to provide health, safety, and heat retention features and yet is easily removable and replaceable on and off the pool water surface.

Briefly, the subject inventive flotation pool blanket comprises a plastic flotatable blanket which extends over the complete surface of the water in the pool and which has parallel spaced ribs underlying the blanket and attached to the blanket. The ribs extend over the sides of the pool to provide means to hold the blanket in place against lateral shifting due to wind or the like and additionally provide handles by which the blanket may be lifted up. By traversing the length of the pool and gathering in turn each of the ribs, the entire blanket is lifted and carried off the water and away from the pool for storage until the blanket is replaced upon the pool.

The invention is characterized by having reinforced end ribs at opposite ends of the pool with a plurality of central ribs equally spaced between the ends. All ribs have an elongated horizontal member with an upright member at each end adapted to be proximate each side of the pool, the upright member then having a right angle ear member which laps over the pool decking to hold the rib in place, and thus also hold the blanket in place. Each rib underlies the blanket and is attached to the blanket by a plurality of spaced apart rivets which penetrate the blanket to the ribs. The ribs are constructed of PVC pipe and PVC pipe couplings or fittings.

It is an object of the subject invention to provide a flotation pool blanket which provides health, safety, and heat retention features while at the same time providing means for easy removal and replacement.

It is further an object of the subject invention to provide a flotation pool blanket that may be lifted from the pool surface by handles which rise up above the pool surface to engage the top of the pool decking.

It is still further an object of the subject invention to provide a flotation pool blanket that may be gathered for removal such that persons may start at one end of the pool and while proceeding the length of the pool, gather up each part of the blanket, lifting it above the water until the total blanket has been lifted out, and then stow the blanket away.

Other objects of the invention will in part be obvious and will in part appear hereinafter. The invention accordingly comprises the apparatus comprising the construction, combination of elements, and arrangement of parts which are exemplified in the following detailed disclosure and the scope of the Application which will be indicated in the claims.

BRIEF DESCRIPTION OF THE DRAWINGS

For further understanding of the nature and object of the present invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
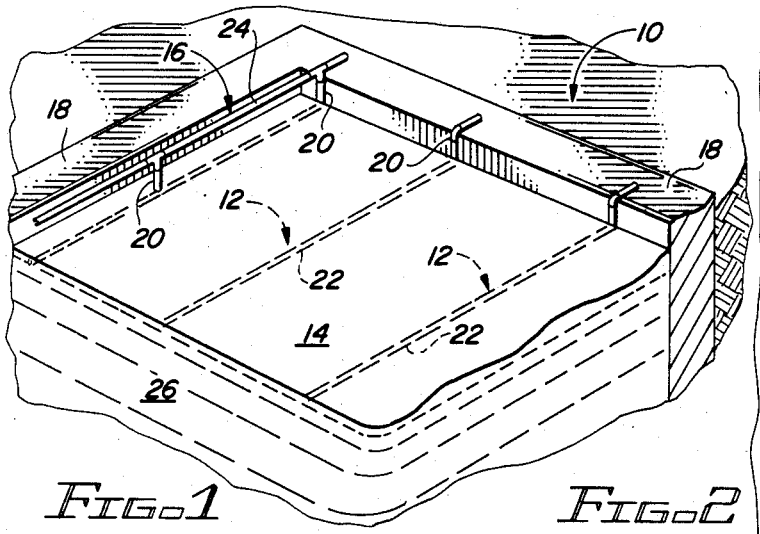
FIG. 1 is a sectioned perspective view of the subject invention in place on a swimming pool.

Referring now to FIG. 1, a perspective sectioned view of the inventive flotation pool blanket 10 installed on a swimming pool is shown. Flotation pool blanket 10 is so positioned to float upon the surface of the water 26 in the swimming pool while supported against lateral movement by the central ribs 12 positionally spaced between the ends of the blanket 14 and the end rib 16. End rib 16 comprises similar construction as central ribs 12 except that it has additional lengthwise reinforcement. The blanket 14 which is preferably constructed of sheet plastic, is attached to the central ribs 12 and the end rib 16 at various spaced points, the preferable method of attachment being rivets with an oversized head which will be shown in later drawings.

The central ribs 12 and end ribs 16 are supported by means of attached ears situated at opposite ends of each rib, the ears adapted to lay upon the deck 18 of the swimming pool. The upright members of the central ribs 12 and end ribs 16 which rise perpendicularly from the horizontal members of the rib have such a length as to reach down to the surface of the water 26 in order to lay the blanket upon the surface of the water, with the ribs horizontal member 22 (shown in dotted form in FIG. 1) lying just underneath blanket 14 and therefore just immediately below the surface of the water 26. The horizontal reinforcing member 24 of end rib 16 is shown above blanket 14 and attaches at the point where the ear of the end rib 16 also attaches.

Figure 2:
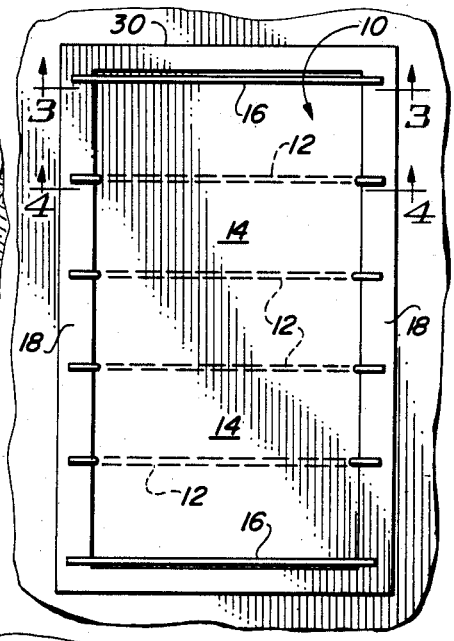
FIG. 2 is a top view of a swimming pool with the subject invention in place.

Referring now to FIG. 2, a top view of the inventive flotation pool blanket 10 is shown in place in a rectangular shaped pool 30. As seen in FIG. 2, the various central ribs 12 are generally equally spaced throughout the length of pool 30 and end ribs 16 are situated at opposite ends. Blanket 14 is shown covering the ribs and also covering the water of the pool. It is anticipated that the blanket should join the sides of the pool with minimal space between the end of the blanket and the side of the pool as it is desired that the pool be completely covered. As can be seen in FIG. 2, the ribs extend from one side to the other and overlap the pool deck 18 on both sides. It is realized of course that while the choice has been to place the ribs across the width of the pool rather than the length of the pool, it is always possible that the ribs can extend the longer length of the pool rather than its shorter width.

Figure 3:
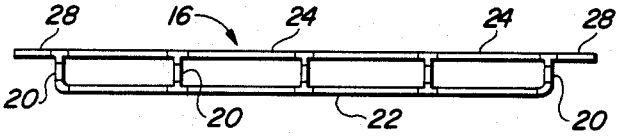
FIG. 3 is a side view of an end rib.

FIG. 3 is a side view of the complete end rib 16 showing in this view the rib lower horizontal member 22, the upper reinforcing member 24, and the upright strengthening members 20 at each end and situated at spaced positions between the two ends. At each end and in line with the upper reinforcing member 24 is rib ear 28, rib ear 28 adapted to rest upon the deck of the pool. Rib ear 28 is connected by means of an appropriate "T" pipe fitting or coupling to upright member 20 and upper reinforcing member 24. All connections between upper reinforcing member 24 and upright member 20 as well as the connection between lower reinforcing member 22 and upright member 20 are effected with appropriate "T" or right angle pipe fittings.

Figure 4:
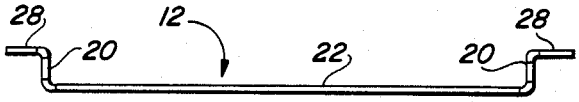
FIG. 4 is a side view of a central rib.

FIG. 4 shows a side view of central rib 12, the usual type adapted to be positioned in the central portion between the ends of the pool. Rib 12 shown in FIG. 4 comprises the rib horizontal member 22, upright member 20, and rib ear 28, all identical to their respective similar element in the end rib 16. All rib members are connected by appropriate right angle pipe fittings.

There is interchangeability between the end rib 16 and centrally located ribs 12 so long as the length to be spanned is not too great. Since the ribs will be picked up and carried along by two members walking on opposite sides of the pool, weight of the blanket and weight of the PVC pipe utilized will be the factors determining whether or not a strengthening upper reinforcing member is necessary. Obviously for extended lengths, the upper reinforcing member 24 will be necessary, and in those cases it is advised that all ribs, including central ribs, be of the same construction as the end rib 16. Similarly, for short widths to be spanned, all ribs, including the end ribs, can be of the simpler construction shown in the central rib of FIG. 4.

Figure 5:
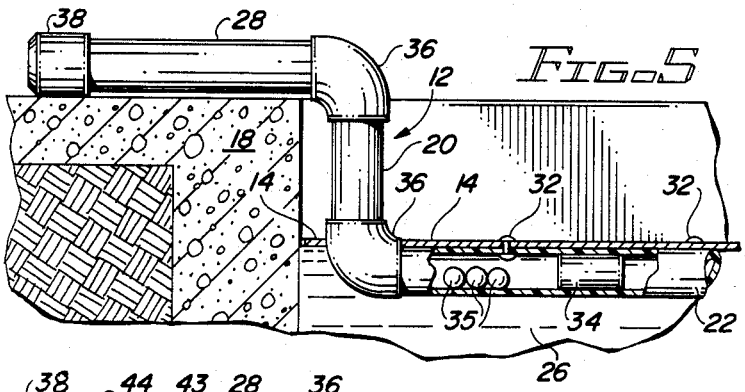
FIG. 5 is an end side view of a central rib with blanket at the edge of the pool.

Continuing, FIG. 5 is a side view of the end of a typical centrally located rib 12 with a partial cutaway view of pool deck 18. In this Figure is illustrated the relationship of blanket 14 to the horizontal member 22 and the water 26. Blanket 14 floats upon the top level of water 26 with the rib horizontal member 22 just below the surface of the water. Blanket 14 is attached to the rib horizontal member 22 by means of a large headed rivets 32 which, in the preferred embodiment, are constructed of aluminum or non-rusting metal such as stainless steel, copper, or the like.

Shown as a solid plug in rib horizontal member 22 is weight 34 which may comprise a heavy metal such as lead or the like, or other heavy material which are employed to add weight to the combined blanket and ribs in order to make the combination more stable in the event of wind or the like. Weights 34 may be spaced at various intervals in the hollow center of the PVC pipe making up the rib or may be substantially filling in the center for the total length. The weights may also comprise round pellets 35 which may be fixed in place or freely moving within the rib horizontal member.

An opening in blanket 14 has been cut in order to encircle upright member 20 so that the blanket extends to the wall of the pool, or if desired, the blanket may terminate in the vicinity of upright 20 and thereby be slightly spaced away from the pool wall. Connected to upright 20 by means of right angle pipe fitting 36 is rib ear 28 which in turn is terminated with end cap 38. Another right angle pipe fitting 36 is shown joining upright member 20 with rib horizontal member 22.

Figure 6:
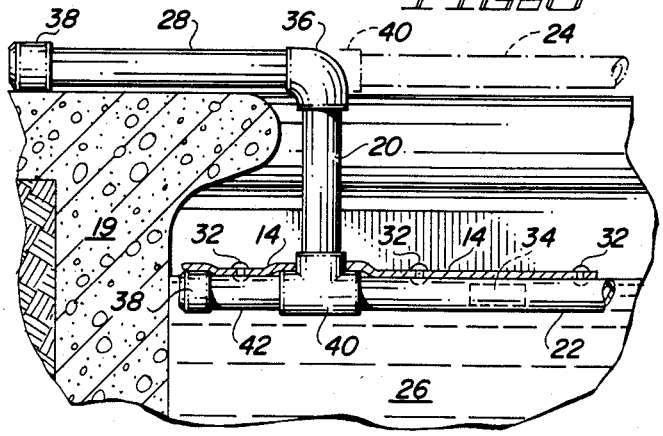
FIG. 6 is an alternate embodiment of a central rib at the edge of the swimming pool where the swimming pool has an overhanging coping.

Referring now to FIG. 6, a variation of central rib 12 is shown to accommodate a pool constructed with an overhanging edge or coping. By the manner of construction shown in FIG. 6, the blanket may still extend to the edge of the wall, however, the upright member 20 is recessed back from the wall sufficiently so as not to interfere with the edge of the deck 19 having the extended coping. Here again, as in FIG. 5, blanket 14 is shown encircling upright member 20 and a portion of "T" pipe fitting 40, and then proceeds over to the wall of the pool. Extending beyond "T" pipe fitting 40 and in line with the rib horizontal member 22 is the rib horizontal member extension 42 which extends to the wall or nearly to the wall of the pool. The blanket 14 is riveted in place to the rib horizontal member 22 and rib horizontal extension member 42 by means of rivets 32, which are the same type of rivets utilized and shown in FIG. 5. Rib horizontal member extension 42 is similarly capped with end cap 38 as is the ear 28 which also is connected to right angle pipe fitting 36, as is also upright member 20. Here, as in the illustration in FIG. 5, blanket 14 lays on top of water 26 with the rib horizontal member 22 immediately below the surface of the water. While rivets have been shown as the means of attachment of the plastic sheet to the ribs, it is possible that different types of attachment may be made, such as using an appropriate water-proof adhesive.

Also shown in dotted form in FIG. 6 is the construction utilized to produce an end rib for the alternate embodiment, and more particularly, the addition of upper reinforcing member 24. A "T" pipe fitting, such as that shown as numeral 40 in FIG. 6, is utilized rather than the right angle pipe fitting 36 shown in order to receive the horizontal upper reinforcing member 24. It is realized of course that the same construction for a standard end rib 16 is utilized for the preferred standard central rib 12 shown in FIG. 5, i.e., the upper right 20 angle pipe fitting 36 shown in FIG. 5 would be replaced by a "T" pipe fitting in order to receive the upper reinforcing member 24.

Figure 7:
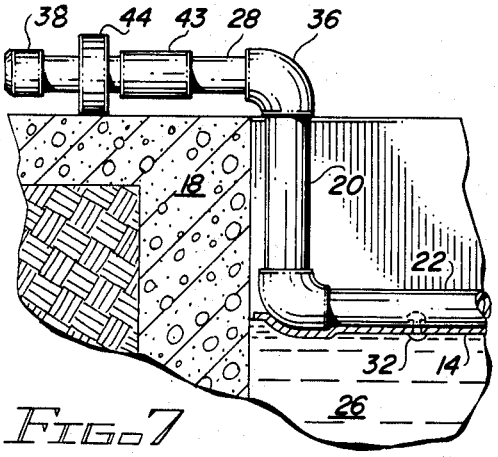
FIG. 7 is an alternate embodiment of a portion of a central rib utilizing wheels on the ear of the rib.

FIG. 7 shows an alternate embodiment of the invention in a side view where a wheel 44 is shown rotationally attached to rib ear 28. It is suggested that a straight fitting, such as shown by numeral 43, be added to rib ear 28 in order to limit sidewise movement of wheel 44. Secondly, in this alternate embodiment, the relative positions of blanket 14 and rib 22 have been reversed inasmuch as here the rib 22 lies atop blanket 14, blanket 14 still lying on the surface of water 26. Again, as before, rivets 32 attach blanket 14 to rib 22.

Figure 8:
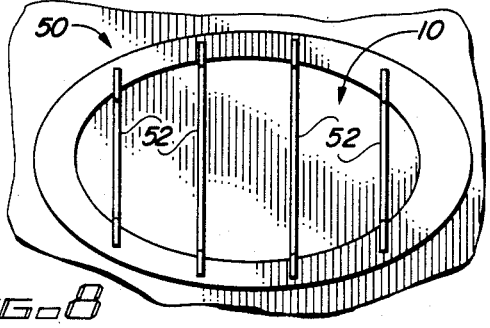
FIG. 8 is an alternate embodiment of a top view of an oval shaped pool with the invention in place.

Lastly, FIG. 8 shows a top view of an oval shaped pool 50 with the inventive flotation pool blanket 10 in place. Here all of the ribs 52 are of different lengths, however, their construction is the same as has been detailed in FIGS. 1 through 6. Again, the choice of type of ribs to utilize in the oval pool shown in FIG. 8, i.e., whether using a central type rib or an end type rib with the added upper strengthening member, is a matter of choice depending upon the length to be spanned, the size and strength of the parts of the ribs, the weight of the blanket, and whether additional weights has been added.

In the preferred construction, the centrally located ribs and end ribs were preferably constructed from PVC pipe, schedule 40, and the various couplings or fittings, i.e., "T" fittings, right angle fittings, straight fittings, and end caps, also from the PVC molded plastic adapted to be used with the PVC pipe. The wheel shown in FIG. 7 may also be made of a rigid plastic for convenience. The blanket 14 which has been utilized in the preferred embodiment was the type of blanket which entrains air bubbles and is manufactured by the Sealed Air Corporation. It is realized that any type of blanket material may be utilized since if the blanket is not sufficiently light enough to float, the ribs themselves will hold the blanket on or above the water.

In utilizing the invention, and when the flotation pool blanket is lying on the surface of the water, the preferred method of removal is for two persons to start at one end on opposite sides of the pool, to reach down and simultaneously pick up the end rib. Then, walking together towards the other end of the pool, proceed to the next central rib, reach down, and pick it up and carry it above the water to the next central rib. The blanket begins to adopt a serpentine type appearance when viewed at the sides. This process is repeated until both parties have reached the other end and then the sole remaining rib is the end rib which is also picked up in the same manner. Since each party is now carrying the total flotation blanket by each of the ears, the blanket may then be carried off to a remote place and then set upon the ground for storage until the pool is to be re-covered.

In applying the inventive flotation pool blanket to the pool, a number of different methods may be utilized. Firstly, opposite ends of all of the ribs are picked up by two persons, one on each side, and then the flotation pool blanket carried to one end of the pool and one end rib set down in the pool. Thereafter, each party proceeds along the edge of the pool, dropping off one of each sequential rib as the blanket, which was folded up in a serpentine type fashion, is let down, until the whole pool is covered. A second method which may be utilized is to bring the flotation pool blanket to the end of the pool and then place one end rib and all the central ribs into the pool, retaining only the other end rib which is to be placed at the opposite end of the pool. Then the parties walk along the sides of the pool causing the flotation pool blanket to unfold and slide across the water, pulling the ribs sequentially with it. The flotation pool blanket will then be completely unfolded on the surface of the water as the two parties reach the opposite end of the pool at which time, the last end rib may be dropped into place.

After the blanket is in place, it may be necessary to ensure that the flotation pool blanket does fully cover the water in the pool and to achieve that, the persons the other side of the pool, and perform the same operation after stationing themselves at each of the pool's ends. It is not anticipated that the same procedure will be necessary to ensure that the pool blanket comes up fully to the sides of the width of the pool since the ribs' position ensures that the blanket is up against the sides of the width.

In the alternate embodiment, it is apparent that the ribs may overlay the blanket and be on top, although it is equally apparent that such an embodiment would place added stress upon the blanket, and may result in tearing of the blanket.

While a preferred embodiment of the invention has been shown and described, together with alternate embodiments, it will be understood that there is no intent to limit the invention by such disclosure, but rather it is intended to cover all modifications of the apparatus and alternate constructions falling within the spirit and the scope of the invention as defined in the appended claims.

I claim:

1. A flotation pool blanket providing a barrier between the environment and the water surface of a swimming pool, and which is easily removable and replaceable, said swimming pool having a width, length, vertical sides and horizontal edges, the pool blanket comprising:

a blanket adapted to cover at least a portion of the water surface of the pool;

at least two elongated end ribs operably attached to said blanket, said end ribs having opposite ends and adapted to span the width of the pool; and ears operably attached to said end ribs to secure said end ribs proximate the water level, said ears defining right angle members, having two ends, one end attached to said end ribs and the other end adapted to engage the horizontal edge of the pool whereby said end ribs secure said blanket at the water surface within the pool as a barrier to the surrounding environment and provide means to remove said blanket by picking up and gathering said end ribs to one end of the pool for removal.

2. The flotation pool blanket as defined in claim 1 wherein said two end ribs are operably attached at spaced apart locations on the blanket.

3. The flotation pool blanket as defined in claim 2 wherein said ears operably attached to said end ribs to secure said ribs proximate the water level define ears attached to each end of said end ribs.

4. The flotation pool blanket as defined in claim 3 further including:

at least one elongated central rib interposed said two end ribs, said central rib having two ends and adapted to span the width of the pool; and means operably attached to said central rib to secure said rib proximate the water level.

5. The flotation pool blanket as defined in claim 4 wherein said means operably attached to said central rib to secure said rib proximate the water level includes ears attached to said rib, said ears defining right angle members having two ends, one end attached to said central rib and the other end adapted to engage the horizontal edges of the pool whereby said central rib may also be picked up and gathered with said end ribs.

6. The flotation pool blanket as defined in claim 5 further including a plurality of central ribs interposed said two end ribs.

7. The flotation pool blanket as defined in claim 6 wherein said end ribs and said central ribs are parallel to each other and evenly spaced apart.

8. The flotation pool blanket as defined in claim 1 wherein each said end rib defines a pair of spaced apart elongated members, said elongated members having at least two transverse members attached at opposite ends.

9. The flotation pool blanket as defined in claim 4 wherein said elongated central rib defines at least one elongated member.

10. The flotation pool blanket as defined in claim 6 wherein said blanket is attached to said end ribs and said central ribs with rivets, said rivets including rivets having enlarged heads.

11. The flotation pool blanket as defined in claim 6 wherein said blanket covers the total water surface of the pool.

12. The flotation pool blanket as defined in claim 7 wherein said end ribs and central ribs are positioned between said blanket and the water surface.

13. The flotation pool blanket as defined in claim 12 wherein said blanket includes a plurality of openings, said openings adapted for the passage of said right angle members of said end ribs and said central ribs through said blanket.

14. The flotation pool blanket as defined in claim 7 wherein said blanket is positioned between said ends ribs and central ribs and the water surface.

15. The flotation pool blanket as defined in claim 7 wherein said blanket defines a plastic blanket with entrained air bubbles.

16. The flotation pool blanket as defined in claim 7 wherein said end ribs and said central ribs and their respective ears comprise PVC plastic pipe.

17. The flotation pool blanket as defined in claim 7 wherein said ears further include attached wheels, said wheels adapted to ride on the pool edge.

* * * * *